US009499888B2

(12) United States Patent
Kirk et al.

(10) Patent No.: US 9,499,888 B2
(45) Date of Patent: Nov. 22, 2016

(54) CARBIDE PELLETS FOR WEAR RESISTANT APPLICATIONS

(71) Applicant: Kennametal Inc., Latrobe, PA (US)

(72) Inventors: Terry W. Kirk, Elkins, AR (US); Hongbo Tian, Xiamen (CN); Xin Deng, Spring, TX (US); Debangshu Banerjee, Irwin, PA (US); Qingjun Zheng, Export, PA (US)

(73) Assignee: KENNAMETAL INC., Latrobe, PA (US)

( * ) Notice: Subject to any disclaimer, the term of this patent is extended or adjusted under 35 U.S.C. 154(b) by 91 days.

(21) Appl. No.: 14/458,918

(22) Filed: Aug. 13, 2014

(65) Prior Publication Data

US 2014/0345423 A1 Nov. 27, 2014

Related U.S. Application Data

(62) Division of application No. 12/827,860, filed on Jun. 30, 2010, now Pat. No. 8,834,786.

(51) Int. Cl.

| | |
|---|---|
| ***C22C 29/06*** | (2006.01) |
| ***C22C 29/10*** | (2006.01) |
| ***C22C 29/08*** | (2006.01) |

(52) U.S. Cl.

CPC ..... *C22C 29/10* (2013.01); *C22C 29/06* (2013.01); *C22C 29/067* (2013.01); *C22C 29/08* (2013.01); *B22F 2998/00* (2013.01); *B22F 2998/10* (2013.01)

(58) Field of Classification Search

None

See application file for complete search history.

(56) References Cited

U.S. PATENT DOCUMENTS

| | | | | |
|---|---|---|---|---|
| 3,149,411 | A | 9/1964 | Smiley et al. | |
| 3,515,540 | A * | 6/1970 | Meadows | C22C 29/067 419/18 |
| 3,800,891 | A | 4/1974 | White et al. | |
| 4,173,685 | A | 11/1979 | Weatherly | |
| 4,177,324 | A | 12/1979 | Brown et al. | |
| 4,451,508 | A | 5/1984 | Brown | |
| 4,526,618 | A | 7/1985 | Keshavan et al. | |
| 4,689,077 | A | 8/1987 | Chevigne et al. | |
| 4,744,943 | A | 5/1988 | Timm | |
| 4,944,774 | A | 7/1990 | Keshavan et al. | |
| 4,945,073 | A | 7/1990 | Dubensky et al. | |
| 5,045,277 | A * | 9/1991 | Penkunas | C22C 1/051 419/15 |

(Continued)

FOREIGN PATENT DOCUMENTS

| | | |
|---|---|---|
| CN | 1433868 A | 8/2003 |
| GB | 2084612 A | 4/1982 |

(Continued)

OTHER PUBLICATIONS

Aug. 29, 2014—Office_Action.

(Continued)

*Primary Examiner* — George Wyszomierski
*Assistant Examiner* — Ngoclan T Mai
(74) *Attorney, Agent, or Firm* — Matthew S. Bedsole

(57) ABSTRACT

Carbide pellets including relatively small amounts of metallic binder are produced by steps of pressing, comminuting, shaping and sintering. The carbide pellets may be used as wear resistant hard facing materials that are applied to various types of tools. The carbide pellets provide improved mechanical properties such as hardness and abrasiveness while maintaining required levels of toughness and strength.

16 Claims, 5 Drawing Sheets

(56) References Cited

U.S. PATENT DOCUMENTS

| | | | |
|---|---|---|---|
| 5,102,452 | A | 4/1992 | Taskinen et al. |
| 5,250,355 | A | 10/1993 | Newman et al. |
| 5,256,608 | A | 10/1993 | Dubensky et al. |
| 5,334,561 | A | 8/1994 | Matsui et al. |
| 5,563,107 | A | 10/1996 | Dubensky et al. |
| 5,612,264 | A | 3/1997 | Nilsson et al. |
| 5,663,512 | A | 9/1997 | Schader et al. |
| 5,681,783 | A | 10/1997 | Nilsson et al. |
| 5,791,422 | A | 8/1998 | Liang et al. |
| RE37,127 | E | 4/2001 | Schader et al. |
| 6,248,149 | B1 | 6/2001 | Massey et al. |
| 6,659,206 | B2 | 12/2003 | Liang et al. |
| 6,782,958 | B2 | 8/2004 | Liang et al. |
| 7,510,034 | B2 | 3/2009 | Curry et al. |
| 7,784,381 | B2 | 8/2010 | Ladi et al. |
| 8,292,985 | B2 | 10/2012 | Curry et al. |
| 8,322,466 | B2 | 12/2012 | Bird |
| 2007/0079992 | A1 | 4/2007 | Curry et al. |
| 2008/0127776 | A1 | 6/2008 | Persson et al. |
| 2008/0127781 | A1 | 6/2008 | Ladi et al. |
| 2009/0260482 | A1 | 10/2009 | Curry et al. |
| 2010/0101866 | A1 | 4/2010 | Bird |
| 2011/0195834 | A1 | 8/2011 | Banerjee et al. |

FOREIGN PATENT DOCUMENTS

| | | | |
|---|---|---|---|
| WO | 0131075 | A1 | 5/2001 |
| WO | 2007124523 | A1 | 11/2007 |

OTHER PUBLICATIONS

Kennametal Inc., “Engineered Product Solutions”, sales brochure, 2006, published in U.S.

* cited by examiner

CARBIDE PELLETS FOR WEAR RESISTANT APPLICATIONS

CROSS-REFERENCE TO RELATED APPLICATION

This application is a divisional application of U.S. patent application Ser. No. 12/827,860, filed Jun. 30, 2010, now U.S. Pat. No. 8,834,786, which is incorporated herein by reference.

FIELD OF THE INVENTION

The present invention relates to wear resistant compositions, and more particularly to carbide pellets containing relatively small amounts of metallic binder for use in various applications such as hard facing materials and bulk composite materials.

BACKGROUND INFORMATION

Carbide pellets may generally be used for wear resistant applications, such as composite materials for forming bits, for example drill bits for earth-boring drills, or as hard facing compositions, for example, hard facing compositions for rock bits or as a plasma tungsten arc coating compositions. When used in hard facing applications, the carbide pellets are generally cemented or sintered tungsten carbide pellets.

U.S. Pat. No. 4,944,774 to Keshavan et al. discloses cemented tungsten carbide used in hard facing materials. The cemented tungsten carbide comprises small particles of tungsten carbide bonded together with cobalt in amounts ranging from 6 to 8 weight percent. The cemented tungsten carbide is made by mixing tungsten carbide, organic wax, and cobalt powders; pressing the mixed powders to form a green compact; and sintering the composite at temperatures near the melting point of cobalt. The resulting dense cemented carbide can then be comminuted to form particles of cemented tungsten carbide for use in hard facing applications. Other hard facing compositions are disclosed in U.S. Pat. Nos. 3,800,891; RE37,127; 6,248,149; 6,659,206; and 6,782,958.

Pan and tube granulation processes have conventionally been used to make carbide pellets containing relatively large amounts of metallic binder, e.g., 6 weight percent cobalt. In these techniques, tungsten carbide powder and cobalt powder are milled with wax in an organic solution for several hours, then the milled powder is dried in a vacuum dryer.

In the pan granulation process, the powder is fed continuously to the top of a rotating disk pelletizer to form green pellets. The disk pelletizer typically rotates at approximately 15 revolutions per minute at an angle of 50° to 75° relative to the horizontal plane. Agglomeration occurs by particle coalescence as the pelletizer rotates. The larger agglomerates rotate to the outer pan rim and are readily discharged from the pan.

In the tube granulation process, the milled and dried powder is fed into a tube or drum pelletizer at one end to form green pellets. The drum pelletizer rotates at approximately 15 revolutions per minute to cause agglomeration by particle coalescence. The agglomerates are continuously discharged at the other end of the tube.

In both the pan and tube granulation processes, the agglomerated green pellets may be sized. Undersized pellets may be recycled, and oversized pellets may be crushed and recycled, by feeding the pellets back to the granulator with the powders. The properly sized green pellets are then sintered, and may be broken into individual pellets if necessary.

While pan and tube granulation processes have effectively been used to make carbide pellets with relatively large amounts of metallic binder, attempts to make carbide pellets containing less than 3 weight percent cobalt by such processes have been unsuccessful. The present invention provides an improved process for forming carbide pellets having a metallic binder, such as cobalt, in an amount less than 3 weight percent.

SUMMARY OF THE INVENTION

An aspect of the present invention is to provide substantially spherical sintered carbide pellets comprising carbide and from 0.5 to 2.5 weight percent of a metallic binder.

This and other aspects of the present invention will be more apparent from the following description.

DETAILED DESCRIPTION

The present invention provides a method of making carbide pellets with relatively small amounts of metallic binder. The sintered carbide pellets may be produced according to the process illustrated in FIG. 1 wherein carbide particles and metallic binder particles in an amount less than 3 percent of the total weight of the carbide and metallic binder powders are mixed together with organic wax, e.g., paraffin wax, pressed to form a green compact, comminuted or crushed to form granules, tumbled to form spherical green pellets, and sintered to form dense spherical sintered carbide pellets. In the initial mixing step, the carbide powder and the metallic binder powder may be milled with wax in an organic solution for several hours, e.g., about 4 to 6 hours, and then vacuum dried.

The milled powders are fed to a press where they are pressed to form a green compact or billet. Any suitable type of press may be used, such as a uniaxial press applying a pressure of from about 2,000 to about 10,000 psi.

Figure 1:
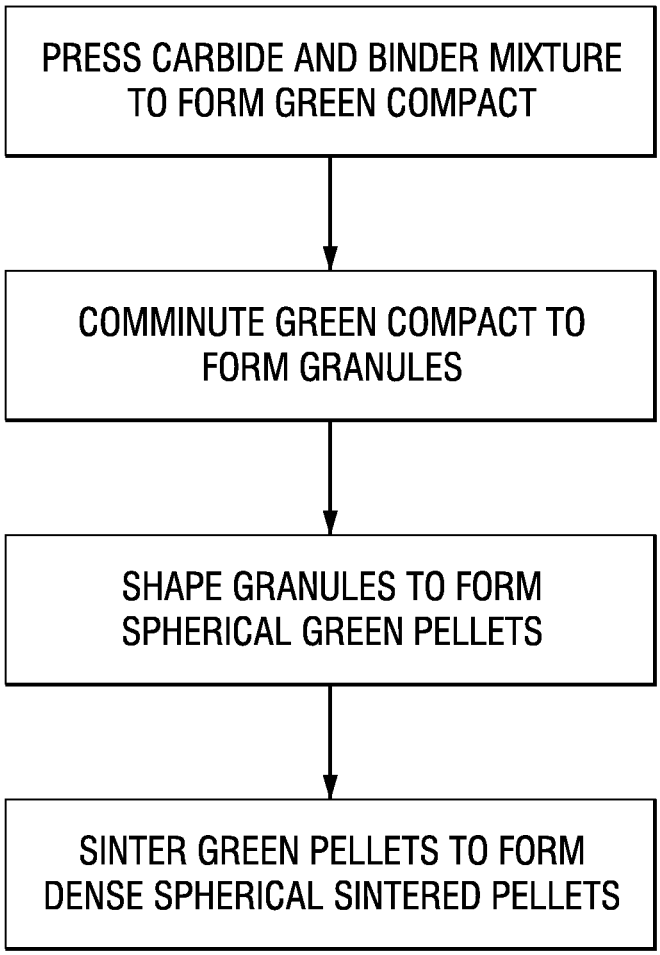
FIG. 1 is a flow chart of a manufacturing process for forming carbide pellets in accordance with an embodiment of the present invention.
Figure 3:
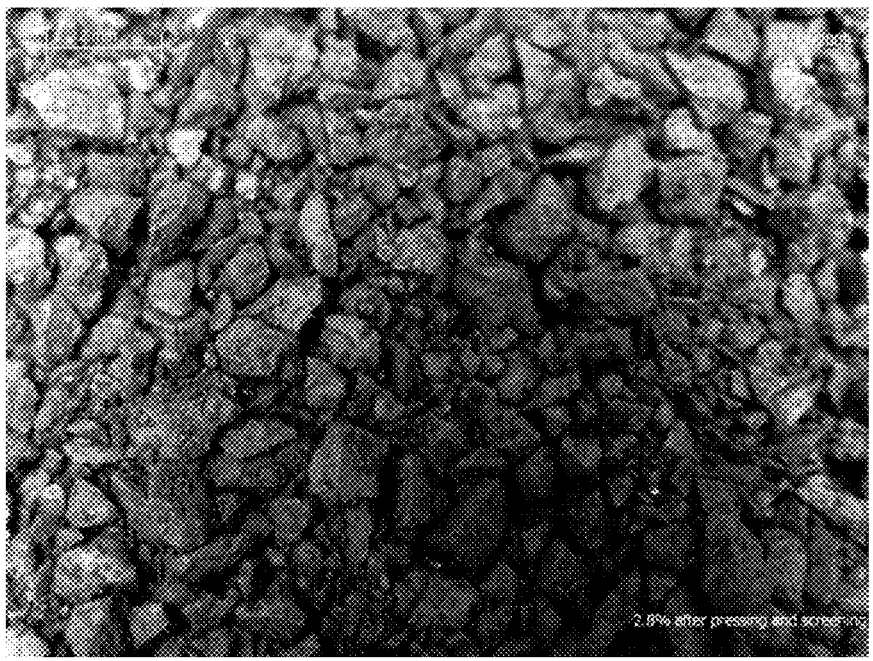
FIG. 3 is a photomicrograph of loose granules formed in a comminuting step of FIG. 1.

The formed green compact or billet is comminuted, e.g., crushed, to form loose, faceted granules comprising the carbide and metallic binder particles. For example, the green compact may be fed to a Stokes granulator to form the granules. A Stokes granulator is a machine that forces the material through a screen to produce granules. The granules have faceted shapes with sharp edges and may typically range in size from about ASTM 200 mesh (74 microns) to about ASTM 10 mesh (1,885 microns), for example, from about ASTM 40 mesh (381 microns) to about ASTM 16 mesh (1,130 microns). A sample of faceted granules produced by the comminuting step of FIG. 1 is shown in the photomicrograph of FIG. 3, as discussed more fully in the example below.

Figure 4:
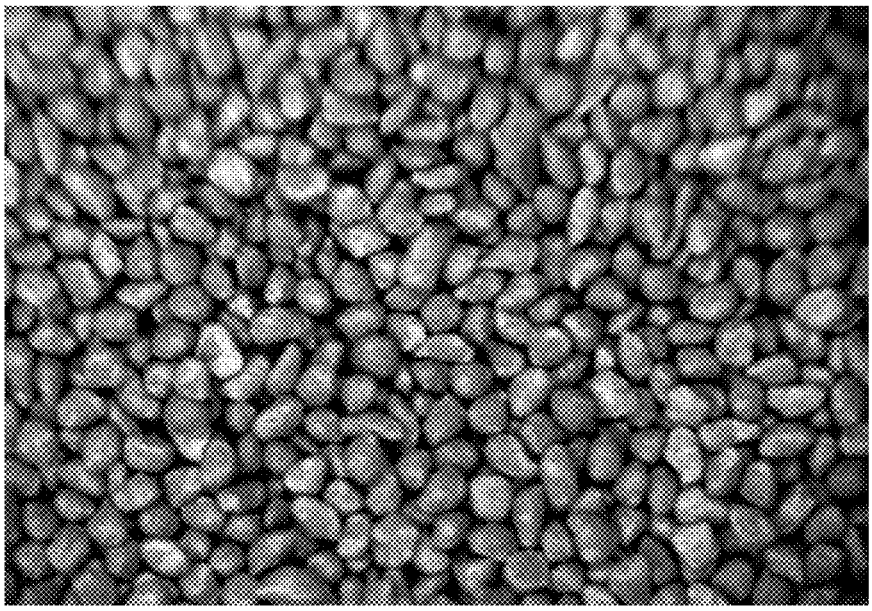
FIG. 4 is a photomicrograph of spherical green pellets formed in a shaping step of FIG. 1.

The faceted granules are then shaped to remove the sharp edges and to form rounded or substantially spherical green pellets containing the carbide and metallic binder. The shaping step may include subjecting the granules to a tumbling process, e.g., in a mill drum, followed by a screening process to obtain uniform pellet size. The rounded green pellets may typically range in size from about ASTM 40 mesh (381 microns) to about ASTM 16 mesh (1,130 microns), for example, about ASTM 20 mesh (860 microns). A sample of rounded and substantially spherical pellets produced by the shaping step of FIG. 1 is shown in the photomicrograph of FIG. 4, as discussed more fully in the example below.

Figure 5:
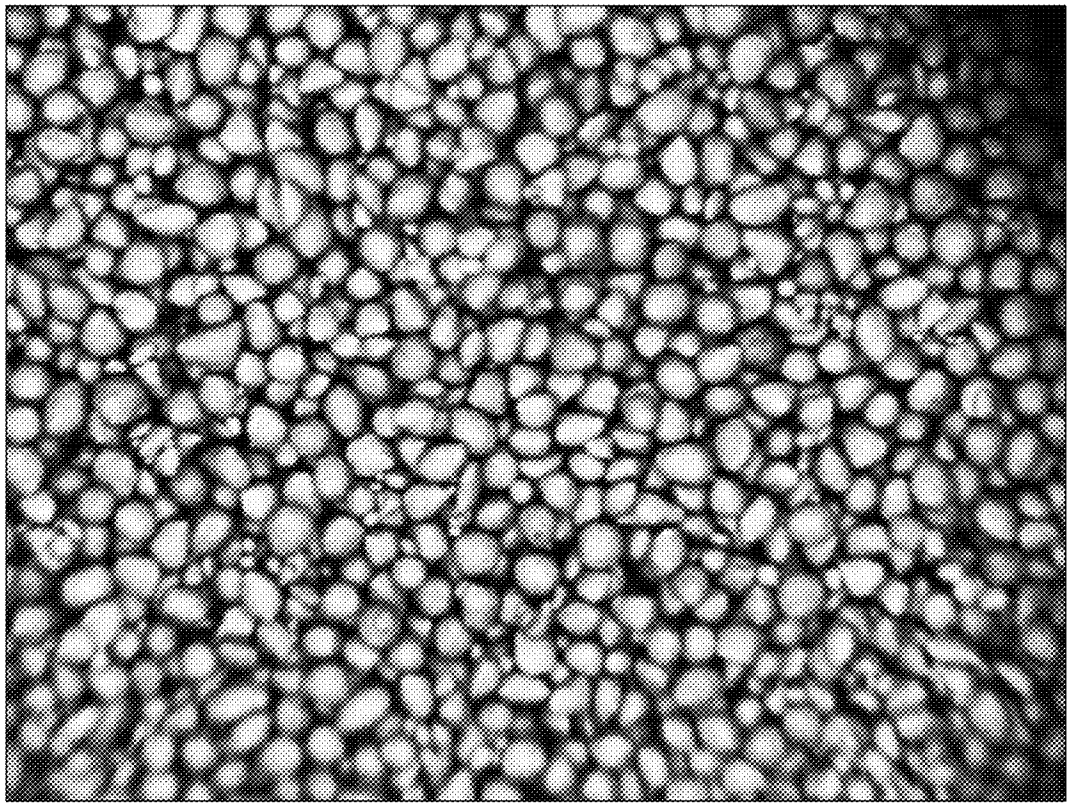
FIG. 5 is a photomicrograph of spherical sintered pellets formed in a sintering step of FIG. 1.

The green pellets are then sintered rather than being sent directly to a press to form parts. The final step involves sintering the green pellets to form dense rounded or substantially spherical sintered carbide pellets, wherein each pellet contains less than 3 weight percent metallic binder based on the weight of the sintered pellet. The sintering temperature may typically range from about 1,380° C. to about 1,480° C., for example, about 1,450° C. Alternatively, vacuum sintering at a temperature of about 1,900° C. may be used, followed by hot isostatic pressing in an inert atmosphere such as Ar, e.g., at 1,500 psi and 1,900° C., or at 30,000 psi and 1,500° C. The rounded sintered pellets may typically range in size from about ASTM 40 mesh (381 microns) to about ASTM-10 mesh (1,885 microns), for example, about ASTM 20 mesh (860 microns). A sample of rounded sintered pellets produced by the sintering step of FIG. 1 is shown in the photomicrograph of FIG. 5, as discussed more fully in the example below.

In an embodiment of the invention, the metallic binder may be present in amounts ranging from zero or 0.01 to about 2.9 weight percent based on the total weight of the mixture. For example, the metallic binder may comprise from about 0.5 to about 2.5 weight percent based on the total weight of the mixture. In one embodiment, the metallic binder is present in an amount of about 2 weight percent. The amount of carbide added in the mixture typically ranges from about 97.1 to about 99.99 or 100 weight percent based on the total amount of the mixture. For example, the carbide may comprise from about 97.5 to about 99.5 weight percent based on the total weight of the mixture. In one embodiment, the carbide is present in amount of about 98 weight percent. The sintered carbide pellets produced in accordance with the method of the present invention comprise hard carbide particles and metallic binder in similar amounts as described above. Due to the relatively low amount of metallic binder in the sintered carbide pellets, their hardness is increased over sintered carbide pellets having higher amounts of metallic binder for a given grain size of the hard carbide particles.

The carbide may be selected from tungsten carbide (WC), di-tungsten carbide ($W_2C$), titanium carbide (TiC), tantalum carbide (TaC), chromium carbide ($Cr_3C_2$) and vanadium carbide (VC). Borides such as titanium diboride ($TiB_2$) may optionally be added to the carbide(s) or used alone. For example, the carbide may comprise WC with up to 10 weight percent $W_2C$. Also, $Cr_3C_2$ in an amount up to 2 weight percent and/or VC in an amount up to 0.5 weight percent may be added to WC. Other optional elements may be added, such as Ni, Ti, Ta and Nb in amounts up to 0.5 weight percent. The carbide may be provided in the form of powder having an average particle size of from about 0.5 to about 10 microns, typically from about 2 to about 4 microns.

The metallic binder may be selected from cobalt, iron, nickel, steel and mixtures thereof. The metallic binder may be provided in the form of powder having an average particle size of from about 0.5 to about 100 microns, typically from about 35 to about 45 microns.

The carbide pellets of the invention may be used in any of the several wear resistant applications which involve surface modification. These include hard facing, plasma tungsten arc and high velocity oxy fuel coating applications. For example, the carbide pellets may be applied as hard facing materials and cutting surfaces to workpieces including tools, such as hand and power shovels, cutting tools, hammers, agricultural tools, drill bits and the like. The carbide pellets may also be used in matrix powders for fixed cutter oil and gas bits. The carbide pellets provide improved mechanical properties, including improved wear resistance compared to currently available carbide pellets containing greater amounts of metallic binder, for example cobalt, while maintaining the required strength and toughness required for longer life of the tools to which the hard facing materials are applied.

Figure 2:
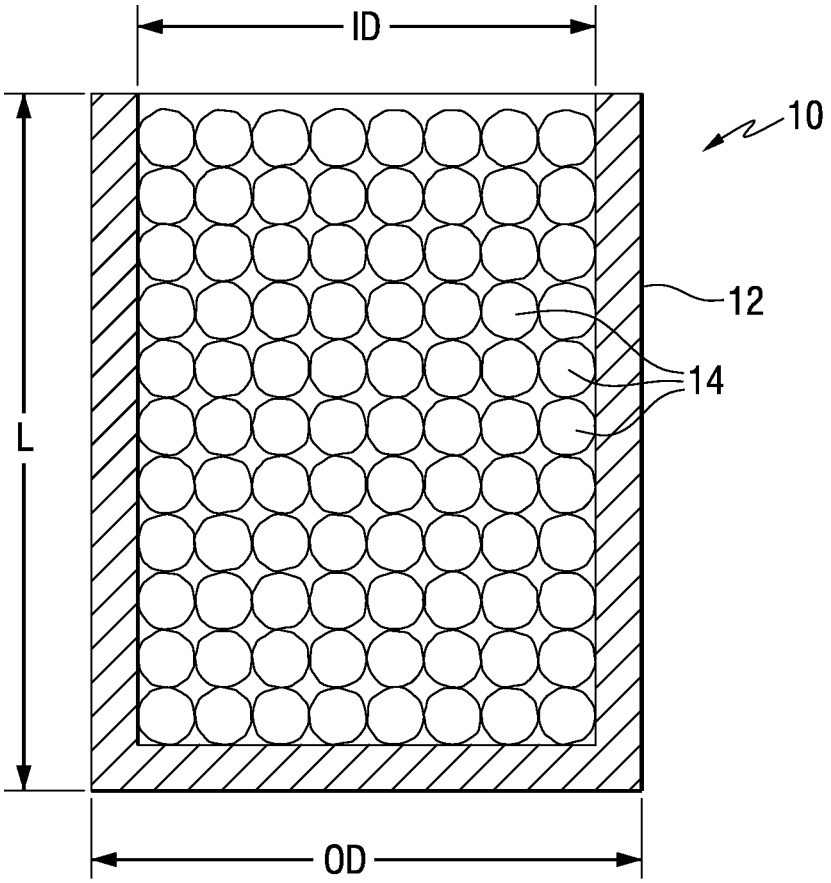
FIG. 2 is a partially schematic longitudinal sectional view of sintered carbide pellets produced in accordance with the present invention inside a metal tube for use as a hard facing rod.

In accordance with an embodiment of the present invention, the sintered carbide pellets of the invention may be used in a hard facing rod 10 in which the pellets are contained in a hard facing tube 12 schematically shown in FIG. 2 with the diameter and length of the rod 10 not drawn to scale. The hard facing rod 10 comprises a mild steel sheet or iron casing tube 12 which contains carbide pellets 14 made in accordance with the present invention. In addition to the carbide pellets 14, other materials typically used in hard facing rods may optionally be included in the tube 12, such as deoxidizers, fluxes and resin binders. The inner diameter ID of the tube 12 may range from about 0.11 inch to about 0.22 inch and the outer diameter OD of tube 12 may range from about 0.13 inch to about 0.28 inch. The tube wall thickness may be from about 0.016 inch to about 0.06 inch. The length L of rod 10 may range from about 10 to about 30 inches.

The hard facing may be applied to various substrates by melting an end of the rod on the surface of the substrate which is to be coated. The steel tube or rod melts as it is welded to the surface and provides the matrix for the carbide particles. The thickness of the hard facing layer on surface of substrate may range from about 0.0625 to about 0.5 inch. A hard facing method which may be used in applying a hard facing composition comprising the sintered tungsten carbide pellets in accordance with the teachings of the invention is disclosed in U.S. Pat. No. 5,250,355 to Newman et al. which is incorporated herein by reference.

The sintered carbide pellets of the invention may be used to form a composite material for use not only as a hard facing on the body and/or cutting elements, but also to form portions or all of the body and cutting elements, and as bulk composite materials. The sintered carbide pellets of the invention may also be used in matrix powders for fixed cutter oil and gas bits, plasma tungsten arc (PTA) powders, and high velocity oxy fuel (HVOF) powders.

The following example is intended to illustrate various aspects of the present invention, and is not intended to limit the scope of the invention.

EXAMPLE

Sintered carbide pellets comprising tungsten carbide particles and 2 weight percent cobalt metallic binder were made. Tungsten carbide powder having an average particle size of about 5 microns was mixed in an amount of 98 weight percent with 2 weight percent cobalt powder having an average particle size of about 1 micron. Paraffin was mixed with the powder in an amount of 2 weight percent of the powder mixture in a ball mill for about 12 hours. The mixture was pressed in a uniaxial press at a pressure of 3 tons per square inch to form a green compact. The green compact was comminuted by forcing the green compact through a Stokes granulator screen which crushed the green compact to form faceted granules having an average particle size of about 1,130 microns. FIG. 3 is a photomicrograph of the faceted granules of the sample showing the sharp edges of the granules.

The faceted granules were then shaped into generally spherical green pellets by tumbling the granules in a mill drum at a speed of about 50 to 120 revolutions per minute for about 60 minutes to round off the sharp edges. FIG. 4 is a photomicrograph of the shaped generally spherical green pellets having an average particle size of about 1,295 microns.

Figure 6:
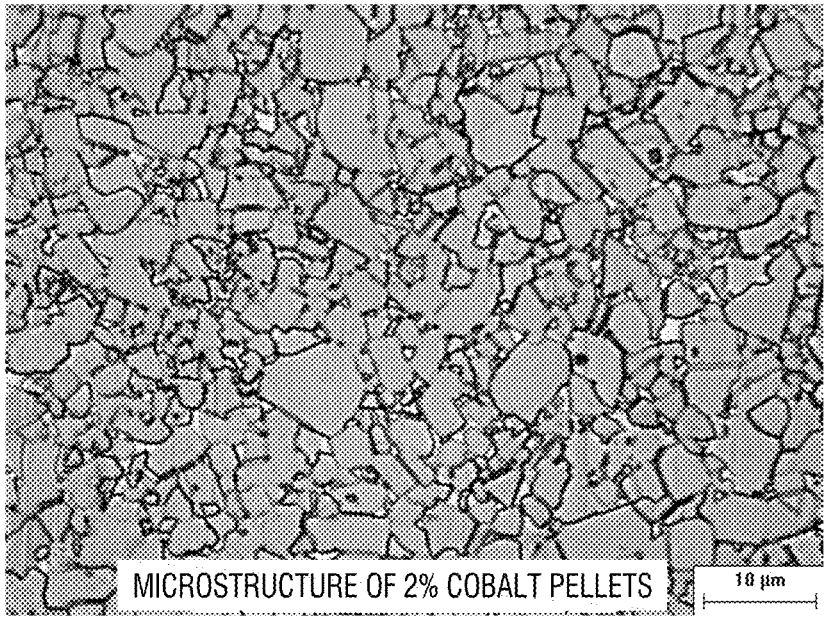
FIG. 6 is a photomicrograph showing the microstructure of a carbide pellet comprising 2 weight percent cobalt made in accordance with an embodiment of the present invention.

The green granulated spherical pellets were loaded in loose form into a ceramic boat and into a sinter hip furnace at about 1,450° C. with a ramp up, hold, and cool down procedure as follows: ramp from room temperature to 400° C. at a ramp rate of 0.5 to 3 degrees per minute; hold for 1 hour at 400° C.; ramp from 400° C. to 1,400° C. at 6 degrees per minute; hold at 1,400 degrees for 30 minutes; and cool down by turning off the power to the furnace to allow cooling at the natural cooling rate of the furnace. During this time, the cobalt melted to help bind or cement adjacent carbide particles together within each pellet. The resultant cemented tungsten carbide pellets were then processed in a roll crusher to break up any of the pellets that became stuck together during the sintering process. The resultant sintered carbide pellets ranged in size from about 200 mesh (74 microns) to about −80 mesh (178 microns), and had an average particle size of about 125 microns. FIG. 5 is a photomicrograph of the dense sintered generally spherical pellets that were formed. FIG. 6 is a photomicrograph of the microstructure of one of the carbide pellets.

A portion of the resultant carbide pellets were then introduced into a hard facing tube, and applied as a hard facing composition to a steel substrate using conventional hard facing application techniques. The hard facing tube was made of a steel sheath, with an inner diameter of 0.156 inch, an outer diameter of 0.18 inch, a thickness of 0.024 inch, and a length of 28 inches.

Figure 7:
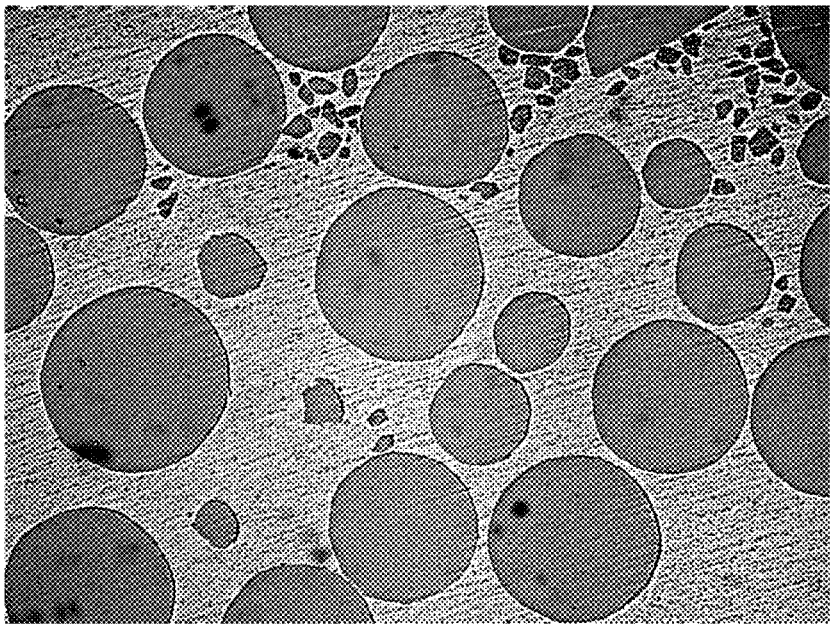
FIG. 7 is a photomicrograph of a section of a hard facing composition deposited on a substrate containing sintered carbide pellets made in accordance with an embodiment of the present invention.

FIG. 7 is a photomicrograph of a cross section of the resultant hard facing composition containing the carbide pellets of the invention as applied to the substrate. The thickness of this hard facing is about 0.125 inch.

Whereas particular embodiments of this invention have been described above for purposes of illustration, it will be evident to those skilled in the art that numerous variations of the details of the present invention may be made without departing from the invention as defined in the appended claims.

The invention claimed is:

1. Substantially spherical sintered carbide pellets comprising carbide and from 0.5 to 2.5 weight percent of a metallic binder, wherein the carbide has an average particle size from about 2 μm to about 4 μm.

2. The substantially spherical sintered carbide pellets of claim 1, wherein the metallic binder is present in an amount of about 2 weight percent.

3. The substantially spherical sintered carbide pellets of claim 1, wherein the metallic binder comprises cobalt, iron, nickel, steel or a combination thereof.

4. The substantially spherical sintered carbide pellets of claim 1, wherein the metallic binder comprises cobalt.

5. The substantially spherical sintered carbide pellets of claim 1, wherein the carbide comprises tungsten carbide, di-tungsten carbide, titanium carbide, tantalum carbide, chromium carbide, vanadium carbide or a combination thereof.

6. The substantially spherical sintered carbide pellets of claim 1, wherein the carbide comprises tungsten carbide.

7. The substantially spherical sintered carbide pellets of claim 1, wherein the substantially spherical sintered pellets have an average size of from about 381 to about 1,885 microns.

8. The substantially spherical sintered carbide pellets of claim 1, wherein the substantially spherical sintered carbide pellets are formed from shaped green pellets.

9. Substantially spherical sintered cemented carbide pellets comprising carbide and from 0.5 to 2.5 weight percent of a metallic binder.

10. The substantially spherical sintered cemented carbide pellets of claim 9, wherein the metallic binder comprises cobalt, iron, nickel, steel or a combination thereof.

11. The substantially spherical sintered cemented carbide pellets of claim 9, wherein the metallic binder comprises cobalt.

12. The substantially spherical sintered cemented carbide pellets of claim 9, wherein the carbide comprises tungsten carbide, di-tungsten carbide, titanium carbide, tantalum carbide, chromium carbide, vanadium carbide or a combination thereof.

13. The substantially spherical sintered cemented carbide pellets of claim 9, wherein the carbide comprises tungsten carbide.

14. The substantially spherical sintered cemented carbide pellets of claim 9, wherein the substantially spherical sintered pellets have an average size of from about 381 to about 1,885 microns.

15. The substantially spherical sintered cemented carbide pellets of claim 9, wherein the substantially spherical sintered cemented carbide pellets are formed from shaped green pellets.

16. The substantially spherical sintered carbide pellets of claim 9, wherein the carbide has an average particle size of 0.5 μm to 10 μm.

* * * * *